United States Patent [19]

Höfer

[11] 4,402,290

[45] Sep. 6, 1983

[54] FUEL INJECTION PUMP

[75] Inventor: Gerald Höfer, Weissach-Flacht, Fed. Rep. of Germany

[73] Assignee: Robert Bosch GmbH, Stuttgart, Fed. Rep. of Germany

[21] Appl. No.: 205,136

[22] Filed: Nov. 10, 1980

[30] Foreign Application Priority Data

Nov. 10, 1979 [DE] Fed. Rep. of Germany ..... 2945484

[51] Int. Cl.[3] ..... F02D 31/00

[52] U.S. Cl. ..... 123/359; 123/387; 123/198 DB

[58] Field of Search ..... 123/359, 357, 387, 338, 123/333, 198 DB, 198 D, 458, 459, DIG. 11, 332, 493

[56] References Cited

U.S. PATENT DOCUMENTS

| | | | |
|---|---|---|---|
| 2,499,706 | 3/1950 | Ward | 123/357 |
| 2,734,496 | 2/1956 | Hammond | 123/198 DB |
| 3,661,130 | 5/1972 | Eheim | 123/359 |
| 3,896,779 | 7/1975 | Omori et al. | 123/458 |
| 4,054,117 | 10/1977 | Palmer et al. | 123/198 D |
| 4,083,346 | 4/1978 | Eheim | 123/198 DB |
| 4,102,316 | 7/1978 | Valbert | 123/198 DB |
| 4,294,204 | 10/1981 | Hurner | 123/198 DB |

*Primary Examiner*—Ira S. Lazarus
*Assistant Examiner*—Magdalen Moy
*Attorney, Agent, or Firm*—Edwin E. Greigg

[57] ABSTRACT

A fuel injection pump is proposed which can be shut off by a magnetic valve if there is a danger of engine "cranking". The magnetic valve is triggered via a switch system in which one switch is actuatable with the adjusting lever of the injection pump, wherein the magnetic valve is furthermore controllable by the supply pump pressure.

9 Claims, 3 Drawing Figures

FUEL INJECTION PUMP

BACKGROUND OF THE INVENTION

The invention relates to a fuel injection pump for internal combustion engines. In known fuel injection pumps of this kind, rpm governing is accomplished by means of centrifugal adjusters or via hydraulically controlled devices. In every case, an rpm is preselected by means of the adjusting lever and this rpm then, via the governor, meters a quantity of fuel for the engine which corresponds to the preselected position of the adjusting lever. As soon as the injection quantity no longer corresponds to the preselected position of the adjusting lever, it is increased or decreased by the governor. It can occur, however, that the governor may no longer reduce the injection quantity in the desired manner; that is, it may no longer shut off or reduce the fuel supply so that there is the danger that the engine will crank. This may occur if, for example, the flyweights of a mechanical centrifugal adjuster stick, some adjusting piston in a hydraulic governor jams, or there are voltage interruptions in the governor in an electrical type governor. Such engine cranking is extremely dangerous, both for the engine and for the vehicle which it drives.

OBJECTS AND SUMMARY OF THE INVENTION

The fuel injection pump according to the invention has the advantage over the prior art that engine "cranking" is prevented, using simple means. Because of this protection against excess rpm in case of governor failure, it is possible to make substantially simpler the effort undergone in the basic governor to provide safety features, especially in the case of the electric governor, because a further independent means of monitoring the control variable is already available. Further advantageous features of the invention are disclosed and will be described in detail below.

The invention wil be better understood and further objects and advantages thereof become more apparent from the ensuing detailed description of two preferred embodiments taken in conjunction with the drawings.

DESCRIPTION OF THE PREFERRED EMBODIMENTS

Figure 1:
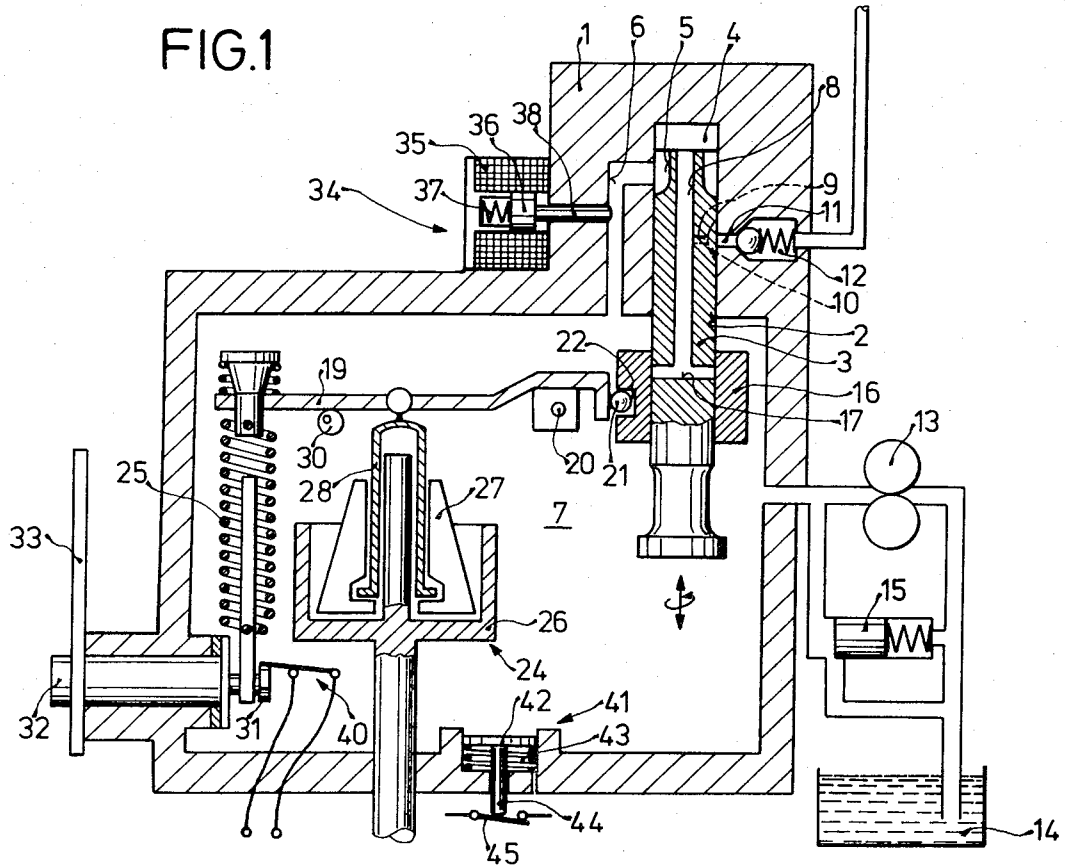
FIG. 1 is a lengthwise cross-sectional view through the first exemplary embodiment, shown in simplified fashion.

As is shown in simplified form in FIG. 1, a pump piston 3 functions within a bore 2 in a housing 1 of a fuel injection pump, being caused by means which are not shown to execute a simultaneously reciprocating and rotary motion. The pump work chamber 4 of this pump is supplied with fuel from a suction chamber 7 via longitudinal grooves 5 disposed in the jacket face of the pump piston and via a bore 6 extending in the housing 1 for as long as the pump piston is executing its intake stroke, that is, is moving in the direction of its bottom dead center position. As soon as the bores 6 have been closed by the rotation of the pump piston, the fuel located in the pump work chamber 4 is delivered via a longitudinal channel 8 extending in the pump piston 3, a radial bore 9 and a longitudinal distributor bore 10 disposed in the surface of the pump piston to one of several pressure lines 11. These pressure lines 11 correspond in number to the number of engine cylinders to be supplied and, being distributed about the circumference, discharge into the bore 2. The pressure lines 11 lead, via one check valve 12 each, to the injection valves, not shown, associated with each of the cylinders.

The suction chamber 7 is supplied with fuel from a fuel container 14 via a supply pump 13. The pressure in the suction chamber 7 is controlled in a known manner in accordance with rpm by means of a pressure control valve 14, so that the pressure in the suction chamber increases with increasing rpm and decreases with decreasing rpm.

An annular slide 16 is displaceable on the pump piston 3 and during the course of the compression stroke opens a radial bore 17 communicating with the axial bore 8, thus determining the supply quantity. The fuel flowing off after this opening has occurred flows back into the suction chamber 7.

The annular slide 16 is displaced via a tensioning lever 19, which is pivotable about a shaft 20. To this end, the tensioning lever 19 has a ball-like head 21 on one end, with which it engages a recess 22 of the annular slide 16. The other end of the tensioning lever 19 is engaged, counter to the force of a governor spring 25 which also engages the tensioning lever 19, by a centrifugal adjuster 24 acting as an rpm signal transducer. The centrifugal adjuster 24 has a carrier 26 for flyweights 27, which together with the carrier 26 are driven via a drive means (not shown) at a constant ratio to the rpm of the pump piston 3. The flyweights 27 are deflected outward by centrifugal force and thus displace a sleeve 28 seated on the shaft of the governor; this sleeve 28 engages the tensioning lever 19 with an rpm-dependent force at a particular point.

The farther downward the annular slide 16 is displaced by the pivoting movement of the tensioning lever 19, the smaller is the quantity of fuel supplied by the injection pump, because the radial bore 17 is opened at a corresponding earlier time during the supply stroke of the pump piston, and a larger portion of the fuel quantity which could be supplied by the pump piston flows back into the suction chamber. The maximum supply quantity is determined by the uppermost position of the annular slide 16, which is defined in turn by an eccentrically adjustable stop 30 of the tensioning lever 19. The extent of downward displacement of the annular slide 16 at a particular rpm is dependent on the force exerted upon the tensioning lever 19 by the governor spring 25. This force is determined in turn by an eccentric 31, which is disposed on a shaft 32. The shaft 32 is rotated by an adjusting lever 33 which is arbitrarily actuatable by the driver of the vehicle. The governor spring 25 is suspended on the eccentric 31 with its end remote from the tensioning lever 19.

The passageway of the bore 6 between the suction chamber 7 and the pump work chamber 4 is controlled by a magnetic valve 34. The magnetic valve has a magnet 35 and an armature 36, which is subject to the force of a spring 37. A movable valve member 38 is disposed on the armature 36, blocking the passageway of the bore 6 whenever the coil 35 is not excited.

A switch 40 is actuated by the eccentric 31. In FIG. 1, this switch 40 is shown in the closed position, a position which corresponds to medium load and rpm. As soon as the adjusting lever 33 is rotated into the idling position, however, the switch 40 is opened by the eccentric 31. When the lever 33 shifts into the idling position, the eccentric 31 leaves its lower position shown in FIG. 1 and assumes an upper position, with the governor spring 25 being simultaneously relaxed in accordance with idling rpm.

A fluid pressure switch 41 is also disposed in the housing 1 of the fuel injection pump. The fluid pressure switch 41 has a piston 42, which is exposed to the pressure in the suction chamber 7 and is displaceable thereby counter to the force of a spring 43. An adjusting member 44 is disposed on the piston 42 and acts upon a switch 45. As soon as the idling rpm level has been exceeded, the piston 42 is displaced by the simultaneously increasing pressure in the suction chamber and opens the switch 45.

The switch 40 and the pressure switch 41 may naturally also be disposed at some other part of the fuel injection pump. It is conceivable, for instance, that the adjusting lever 33 may be outside the housing 1 of the fuel injection pump, acting upon the switch 40 either directly or indirectly. It is further conceivable that the magnetic valve 34 may be disposed in a relief bore of the pump work chamber instead of in the bore 6, the relief bore being opened for the purpose of shutting off the engine.

Figure 2:
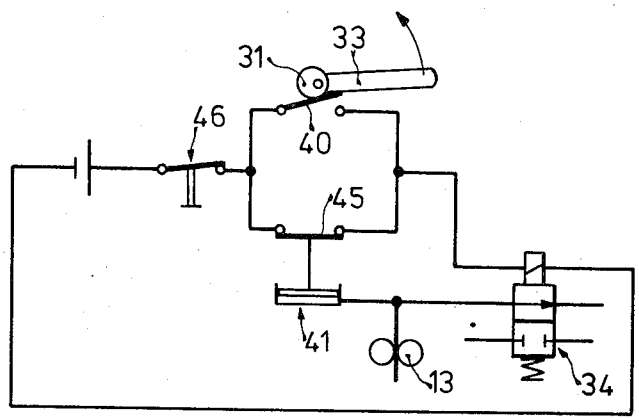
FIG. 2 is an electric switching diagram of the first exemplary embodiment, having two parallel switches for controlling the magnetic valve.

In FIG. 2, the electric circuit of the magnetic valve 34 is shown. The first element in this circuit is a main switch 46, which can be switched on and off by the ignition lock of the engine. Generally, in a motor vehicle, the steering lock is also combined with the ignition lock. The switches 40 and 45 are disposed in parallel in this electric current circuit, each assuming the switching position for idling rpm as shown in FIG. 2. As is shown in simplified form, the switch 40 is opened at the idling position as a result of the corresponding position of the eccentric or of the adjusting lever 33. The switch 45, in contrast, is closed, because the pressure supplied by the supply pump 13, at this low, idling rpm level, is insufficient to open it. Because the switching circuit is closed via the switches 46 and 45, the magnetic valve 34 is opened and permits the fuel supplied by the supply pump 13 to flow (out of the suction chamber 7) into the pump work chamber 4.

As soon as both switches 40 and 45 are opened, that is, in the event of a disruption of normal governor operation, the magnetic valve 34 closes, functioning in this case as a magnetic valve which closes whenever there is no current flowing through it. If a magnetic valve of this kind controls a relief line, as referred to above, then it is embodied instead as a valve which opens whenever there is no current flowing through it. In either case, the magnetic coil 35 must be switched on over the entire operational period. However, it is also conceivable that operation may be accomplished with a magnetic valve whose magnet is not excited during normal operation, and prevents the fuel supply to the engine only in the event of a disruption in governing the injection pump. In such a case, the desired safety circuit would be provided by closing at least one of the two switches 40, 45. This may be attained more favorably in some cases by an in-line disposition of the switches 40 and 45.

It is of the essence of the invention that if there is a failure on the part of the normal governor, such as a centrifugal or hydraulic governor, the fuel supply to the engine is interrupted whenever the fuel quantity preselection lever assumes a position for idling quantity but the actual fuel supply quantity remains at a level which is undesirably higher than that.

Figure 3:
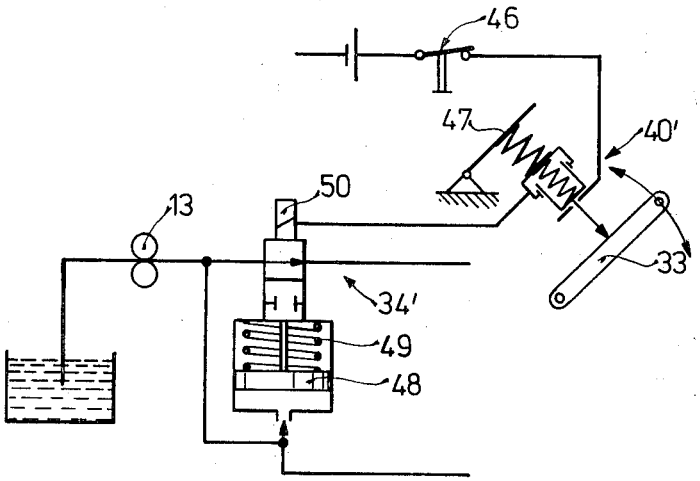
FIG. 3 shows the second exemplary embodiment having a hydraulically actuated magnetic valve.

In the second exemplary embodiment shown in FIG. 3, only one switch 40' is used in the safety circuit. The rpm-dependent pressure engages the magnetic valve 34' directly. The main switch 46, which is used in this embodiment as well, may be actuated with the ignition lock and is disposed ahead of the safety circuit.

The switch 40' is disposed in this case between the gas pedal 47 and the adjusting lever 33 and is embodied as a travel switch. At a predetermined position of the gas pedal 47 as it is depressed, the travel switch 40' switches on, before the adjusting lever 33 and the pump governor have attained the rpm at which the supply pump pressure has attained a predetermined switching value.

The magnetic valve 34' is embodied as being opened in the rest position. The movable valve member of the magnetic valve 34' is urged in the closing direction by the supply pump pressure via a piston 48 and is urged in the opening direction by a spring 49. The magnet 50 acts in the opening direction and keeps the magnetic valve 34' open in the switched-on state, even when the supply pump pressure increases. Thus the magnetic valve 34' is held open via the switch 40' beyond a predetermined position of the gas pedal, with this opening position being fixed by the embodiment of the switch 40', before the supply pump pressure attains a shutoff value. If the gas pedal is now placed in the idling position (zero position), during overrunning or in the event of engine "cranking", for instance, then the switch 40' immediately shuts off the magnet 50, without waiting for the adjusting lever 33 to attain its return position. The supply pump pressure above the shutoff value displaces the valve 34' via the piston 48, counter to the force of the spring 49, into its blocked position. Upon renewed depression of the gas pedal, the magnet 50 is once again immediately excited, so that the valve 34' opens again virtually without hysteresis.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines comprising a supply pump arranged to generate an rpm-dependent fuel pressure, an adjusting lever arranged to preselect the rpm and an electrically actuatable valve positioned relative to a fuel line bore that communicates with a pump work chamber, at least one switch actuatable with the adjusting lever disposed in an electric line leading to said electrically actuatable valve, said electrically actuatable valve being controllable in accordance with the supply pump pressure whereby at an idling position of the adjusting lever and at an actual supply pump pressure which is larger than the supply pump pressure at the idling speed of the injection pump the injection of fuel is interrupted by closing said fuel line bore by means of said electrically actuatable valve.

2. A fuel injection pump as defined by claim 1, wherein at least two switches including first and second switches are disposed in parallel in an electric line and the first switch is open at a position of the adjusting lever corresponding to low rpm (idling rpm) but is closed at a position corresponding to a slightly higher rpm, while in contrast, the second switch is closed at idling rpm and is opened when the rpm and thus the fuel pressure are increasing.

3. A fuel injection pump as defined by claim 1, wherein the second switch is embodied as a fluid pressure switch, which is exposed to the fuel pressure of the supply pump.

4. A fuel injection pump as defined in claim 1, wherein an adjusting piston exposed to the supply pump pressure urges the electric valve in the closing direction and a spring and the electric actuation means urge the electric valve in the opening direction.

5. A fuel injection pump as defined by claim 1, wherein the switch which is actuatable with the adjusting lever is disposed as a travel switch between the gas pedal and the adjusting lever.

6. A fuel injection pump as defined by claim 5, wherein the switch is actuable on at an rpm corresponding to the adjusting lever position, which is lower than the rpm at which the supply pump pressure overcomes the force of the spring.

7. A fuel injection pump as defined by claim 1, wherein a supply pump driven with a pump piston is integrated in a housing of the injection pump and a large part of the pump housing is under supply pump pressure.

8. A fuel injection pump as defined by claim 1, wherein the electrically actuated valve is disposed in the fuel line between the supply pump and the pump work chamber of the fuel injection pump.

9. A fuel injection pump as defined by claim 1, wherein the electrically actuated valve is embodied as a magnetic valve.

* * * * *